US005077866A

United States Patent [19]

Tsai

[11] Patent Number: 5,077,866

[45] Date of Patent: Jan. 7, 1992

[54] BELT FASTENER

[76] Inventor: Yuh L. Tsai, 5th Fl., 62 MinChuan Road, Hsin Tien, Taipei, Taiwan

[21] Appl. No.: 566,828

[22] Filed: Aug. 14, 1990

[51] Int. Cl.[5] ..... A44B 11/22

[52] U.S. Cl. ..... 24/163 K; 24/176; 24/186; 24/265 BC; 24/694

[58] Field of Search ..... 24/163 R, 163 K, 176, 24/68 SK, 694, 265 R, 265 BC, 186; 2/321, 322; 411/103

[56] References Cited

U.S. PATENT DOCUMENTS

| | | | |
|---|---|---|---|
| 609,918 | 8/1898 | Steinberger | 24/694 X |
| 1,345,750 | 7/1920 | Beaumont | 2/321 X |
| 1,421,690 | 7/1922 | Howard | 2/321 |
| 1,462,049 | 7/1923 | Rivelis | 24/694 |
| 2,273,648 | 2/1942 | Kost | 411/103 |
| 4,273,276 | 6/1981 | Perkins | 24/694 X |
| 4,318,207 | 3/1982 | Stroud | 24/163 K |
| 4,669,153 | 6/1987 | Olivieri | 24/68 SK |

*Primary Examiner*—James R. Brittain

*Attorney, Agent, or Firm*—Fleit, Jacobson, Cohn, Price, Holman & Stern

[57] ABSTRACT

A belt strap is provided having a non-circular opening formed through one end portion thereof and a plurality of apertures formed through and spaced along the other end portion thereof. A belt fastener is provided including an adornment assembly for mounting from the outer side of the belt strap about the opening therethrough and a belt length adjusting assembly for mounting on the inner side of the belt strap about the opening formed therethrough. One of the assemblies includes a projection snugly received through the opening and the other assembly includes a threaded shank threadedly engaged in a threaded bore formed in the projection and the two assemblies define abutment surfaces between which portions of the belt strap disposed about the opening are received. The adornment assembly includes an adornment facing outwardly of the outer side of the belt and the belt length adjusting assembly includes a smooth shank facing outwardly of the inner side of the belt, which smooth shank is selectively receivable in the apertures formed in the other belt end portion.

9 Claims, 5 Drawing Sheets

BELT FASTENER

BACKGROUND OF THE INVENTION

1. Field of the Invention

This invention relates to a belt fastener employing a new buckle style and structure, or type of belt buckle design. The belt fastener functions as a belt adornment and as a belt length adjusting fastener and further departs from the traditional shape, pattern and limitations of conventional belt buckles, etc.

The belt fastener can be more easily manufactured at low cost and with simplified assembly. Further, the belt fastener can include many different adornment shapes and patterns and can be fully developed from an esthetic standpoint through creative thinking of a designer. The artistic value and practical usage of the belt fastener comprise major advantages of the present invention.

2. Description of Related Art

One form of belt length adjusting fastener commonly used incorporates a D-shaped ring secured to one end of a belt and equipped with a pivoted anchor shank receivable through an opening provided therefore in a reversely turned portion of the other belt end.

In addition, a second type of conventional belt buckle utilizes a generally D-shaped ring including a belt end anchoring stud and which is clamped to the buckle end of the belt through the utilization of a pivoted tooth anchor which bites into the associated belt end.

A third type of conventional belt buckle or fastener utilizes a fastener anchored to a belt end through the use of a pair of rivet-type fasteners.

SUMMARY OF THE INVENTION

The belt fastener of the instant invention incorporates a stud-type fastener which has one end semi-permanently secured through an opening provided therefore in one end portion of the associated belt and defines a headed shank on the other end selectively receivable through one of a plurality of openings formed through and spaced longitudinally of the other end of the belt. The one end of the stud-type fastener may include any shape, size or type of removable adornment desired and, thus, the belt fastener of the instant invention is more versatile in the various types and forms of adornments which may be used in conjunction therewith.

The main object of the present invention is to provide a belt fastener which may be semi-permanently secured to one end of a belt, utilized to form an adjustable anchor relative to the other end of the belt at points spaced longitudinally therealong and which will also enable the use of substantially any type of adornment in conjunction therewith independent of the style, shape or size of the associated belt.

Another object of this invention is to provide a belt fastener which may be more easily constructed and manufactured in a more cost effective manner.

A further object of this invention is provide a belt fastener which may be installed at any proper position along the belt regardless of its size.

A still further object of this invention is to provide a belt fastener which may be used in designs of wider scope and with which adornment designs of varied sizes and shapes may be used by belt designers.

Another object of this invention is to provide a belt fastener which may be installed relative to an associated belt independent of sewing, riveting and other time consuming and costly operations.

A still further object of this invention is to provide a belt fastener which may be readily interchanged from belt to belt and which may have its adornment feature readily changed.

A further object of this invention is to provide a belt fastener which may be transferred from one belt to another independent of belt width and thickness limitations.

A final object of this invention to be specifically enumerated herein is to provide a belt fastener in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1B:
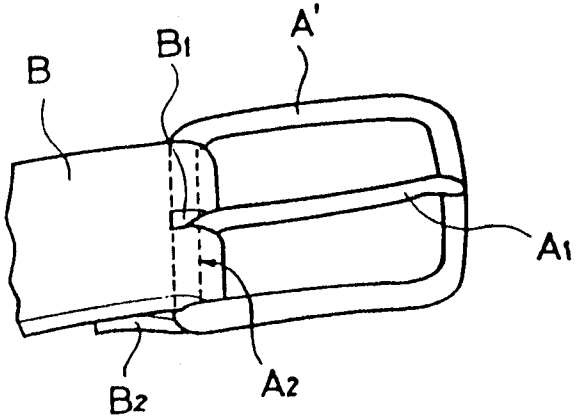
FIG. 1B (PRIOR ART)
FIG. 1B is a perspective view of a second conventional prior art belt buckle utilizing a pivoted belt end anchoring shank.
Figure 1A:
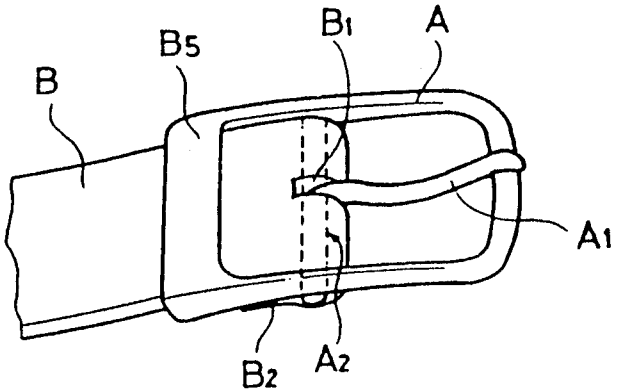
FIG. 1A (PRIOR ART)
FIG. 1A is a perspective view of a first form of conventional prior art belt buckle utilizing a pivoted belt end anchoring shank.
Figure 1C:
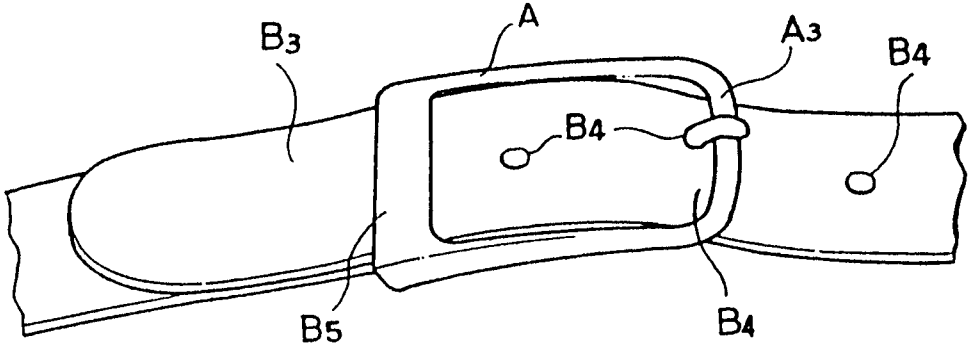
FIG. 1C (PRIOR ART)
FIG. 1C is a perspective view of the conventional prior art belt buckle of FIG. 1A illustrated in operative association with the other belt end.

Referring now more specifically to the drawings FIG. 1 illustrates a conventional style belt buckle incorporating a D-shaped frame A incorporating a center cross pin $A_2$ and having an anchor shank $A_1$ pivotally mounted from the longitudinal center of the cross pin $A_2$. The belt buckle is operatively associated with a belt B including a reversely turned end $B_2$ and the belt B is provided with a short longitudinal slot or opening $B_1$ at the reversely turned portion thereof through which the base end of the pivoted anchor shank $A_1$ projects, the free end of the pivoted anchor shank $A_1$ being abuttingly engagable with the frame A. The frame A shown in FIG. 1A is anchored relative to one end of the belt B and the other end of the belt B includes longitudinally spaced openings $B_4$ formed in the end $B_3$ of the belt B remote from the frame A, see FIG. 1C.

Referring now to FIG. 1B, a second form of conventional prior art belt buckle is illustrated including a frame A'. The frame A' is substantially identical to the frame A except that it is somewhat fore shortened and does not include the cross tongue $B_5$ included in the frame A illustrated in FIG. 1A and FIG. 1C. However, the buckle of FIG. 1B incorporating the frame A' otherwise is structurally and operationally equivalent to the frame A illustrated in FIG. 1 and FIG. 1C.

Figure 2:
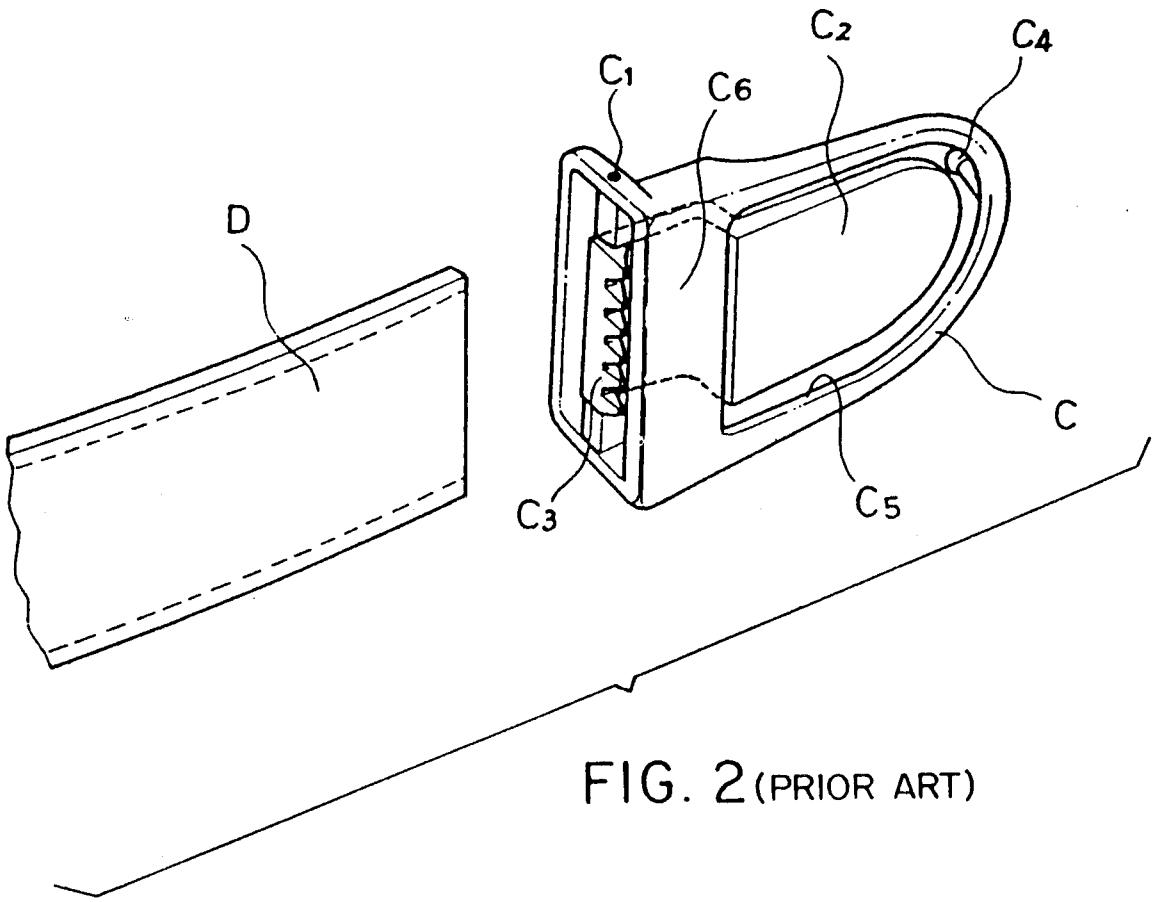
FIG. 2 (PRIOR ART)
FIG. 2 is an exploded perspective view of a conventional prior art belt buckle utilizing a pivoted, toothed anchor.

With reference now to FIG. 2, a second form belt buckle is illustrated including a D-shaped frame C having a pivoted tongue $C_2$ pivotally supported therefrom as at $C_1$ and including belt end gripping teeth $C_3$. The tongue $C_2$ may be pivoted forwardly through the opening $C_5$ defined by the frame C and the end of the belt D may be inserted between the teeth $C_3$ and the cross piece $C_6$ of the frame C. Thereafter, the tongue $C_2$ may be swung to the position thereof illustrated in FIG. 2 in order to clamp engage the end of the belt D between the teeth $C_3$ and the cross piece $C_6$.

In each of the prior art belt buckles shown in FIG. 1A, FIG. 1B, FIG. 1C and FIG. 2, the frame is generally D-shaped and must be of a width greater than the width of the associated belt. Further, the belt buckles illustrated in FIG. 1A, FIG. 1B, and FIG. 1C tend to deteriorate in the area of the reversely turned portions and the slots or openings $B_1$ and the end of the belt D engaged between the teeth $C_3$ and the cross piece $C_6$ of the belt buckle illustrated in FIG. 2 eventually becomes deteriorated.

The frame C in FIG. 2 includes a headed shank $C_4$ for engagement in selected openings (such as the openings $B_4$ illustrated in FIG. 1C) provided in the belt D and thus may be used to adjust the effective length of the belt D.

The construction of the frames A, A' and C is relative complex and the reversely turned belt ends at $B_2$ must be secured in place either by stitching, riveting or other means. These manufacturing procedures are eliminated with the belt fastener of the instant invention, thus eliminating the need for additional machinery and manufacturing steps.

Figure 3:
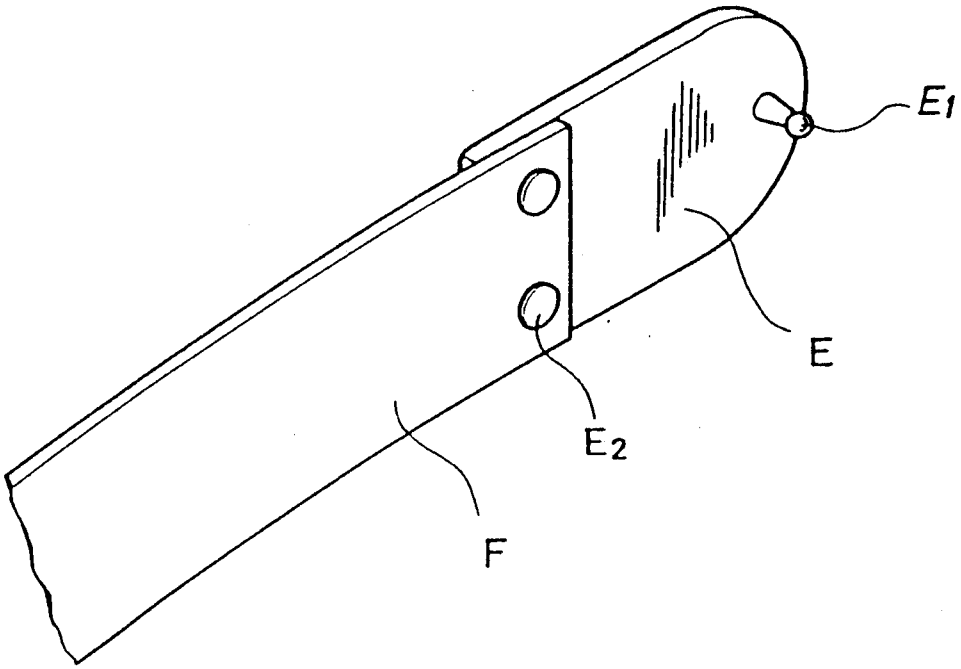
FIG. 3 (PRIOR ART)
FIG. 3 is a perspective of a third conventional prior art belt buckle.
Figure 4:
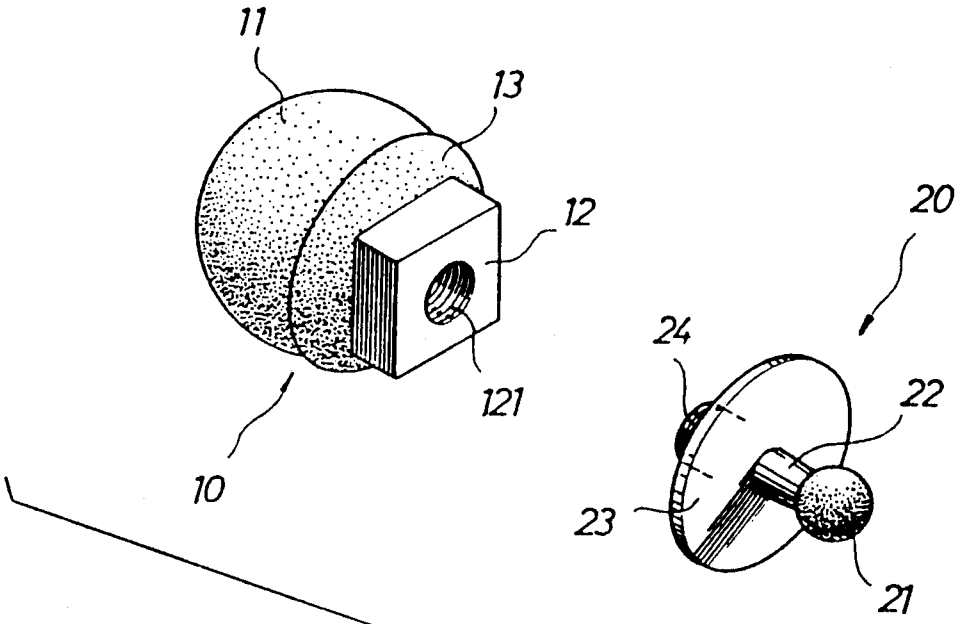
FIG. 4 is an exploded perspective view of the belt fastener of the instant invention.
Figure 6:
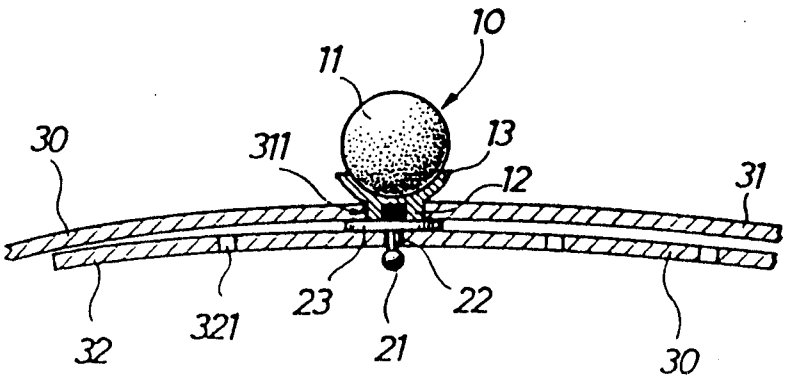
FIG. 6 is a fragmentary longitudinal sectional view of the overlapped engaged ends of a belt anchored together with the belt anchor of the instant invention.
Figure 7:
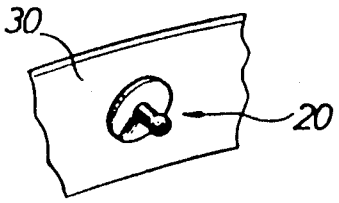
FIG. 7 is an inside fragmentary perspective view of a belt end with which the belt fastener of the instant invention is operatively engaged.
Figure 5:
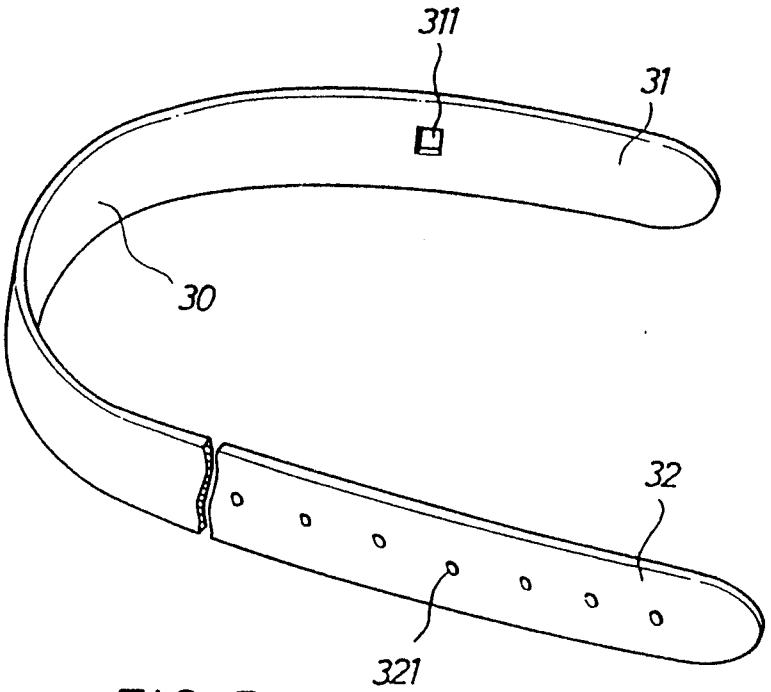
FIG. 5 is a perspective of a belt with which the belt fastener of FIG. 5 may used, a central portion of the belt being broken away and illustrated in vertical section.

The direct pinning and buckling style illustrated in FIG. 3 relies upon the provision of a fastener or anchor E secured to one end of the belt F through the utilization of shank type fasteners such as rivets $E_2$ and the fastener or anchor includes an anchor shank $E_1$ engagable through selected longitudinally spaced openings (not shown) formed in the other end of the belt F corresponding to the opening $B_4$. The direct pinning and buckling style illustrated in FIG. 3 also requires assembly of the components E, $E_2$ and F and does not enable the fastener or anchor E to be transferred from one belt to another.

FIGS. 4–7 illustrate the presently preferred embodiment of the instant invention. The belt fastener incorporates an ornament assembly referred to in general by the reference numeral 10 and a belt length adjuster assembly referred to in general by the reference numeral 20.

The ornament assembly 10 includes an ornament body 11 which may be of any desired shape or size and an ornament seat 13 from which the ornament body 11 is supported and which also serves as a belt abutment member. The ornament seat 13 supports an ornament mount 12 therefrom equipped with a threaded blind bore 121 and the ornament mount 12 is non-circular in plan.

The belt length adjuster assembly 20 includes a belt length adjusting shank 22 and a threaded shank 24 which project in opposite axial directions from opposite sides of a circular abutment flange 23. The shanks 22 and 24 are axially aligned and the end of the shank 22 remote from the flange 23 includes an integral slightly enlarged ball 21 thereon. The threaded shank 24 is threadingly receivable within the threaded blind bore 121 as will be hereinafter apparent.

The fastener comprising the ornament assembly 10 and the belt length adjuster 20 is utilized in conjunction with a belt 30 which may be constructed of conventional material (such as leather) and the belt 30 includes a first belt end portion having a plurality of longitudinally spaced adjustment openings 321 formed therein. The belt 30 includes a second belt end portion having a non-circular opening 311 formed therein. Thus, the belt 30 may be readily manufactured by simple manufacturing machinery and at a low cost.

The opening 311 is of a size and shape to snugly receive the ornament mount 12 therethrough thereby preventing translational and rotational movement as is clear from the figures. When mounting the ornament assembly 10 and the belt length adjuster assembly 20 on the belt 30, the ornament mount 12 is inserted through the opening 311 from the outer side of the belt, the ornament mount 12 being of a thickness measured axially of the bore 121 substantially equal to the thickness of the belt 30. Then, the threaded shank 24 is threaded into and bottomed in the threaded bore 121 from the inner side of the belt end portion 131 and tighted to "jamb" the threads. The end portion 31 of the belt 30 is then clamped between the abutment flange 23 and the ornament seat and belt abutment member 13 to securely anchor the second end portion 31 of the belt 30 relative to the belt fastener comprising the ornament assembly 10 and the belt length adjuster assembly 20.

When in use, the belt is encircled about the waist of the user and the end portions 31 and 32 are end overlapped an amount necessary to properly fit the belt to the size of the waist of the user with the first belt end portion 32 disposed inwardly of the second belt end portion 31.

Then, the belt length adjusting shank 22 with the shank ball 21 on its free end is inserted through one of the adjacent openings 321 in order to secure the belt 30 about the waist of the user.

It is deemed obvious that the length or snugness of the belt 30 may be readily adjusted by simply withdrawing the shank 22 from one of the openings 321 and inserting the shank 22 into an adjacent opening 321.

The ornament body 11 may of course assume any shape or reasonable size and it is deemed obvious that the ornament assembly 10 may be substituted for by another ornament assembly 10 (not shown) having a different design or shape of ornament body 11 in the event the user of the belt 30 desires to make a fashion change in his or her belt. In addition, not only is a readily fashion changeable belt fastener provided, but a belt fastener which may be used in conjunction with a belt strap manufactured by the simplest of manufacturing procedures. Still further, the ornament assembly 10, independent of the specific type of ornament body 11 provided thereon, may be manufactured at an extremely low cost and, therefore, a person using the belt fastener of the instant invention may economically build up a selection of differently designed ornament assemblies 10 for use on different occasions.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination, a belt incorporating an elongated, at least semi-flexible strap having first and second end portions, one of said end portions including a non-circular opening formed therethrough, the other end portion of said belt including a plurality of apertures formed therethrough and spaced longitudinally of said other end portion, a belt fastener for said belt including an adornment assembly and a belt length adjusting assembly, said assemblies defining abutments abuttingly engaged with opposite side surfaces of said strap about said non-circular opening, one of said assemblies including an outwardly projecting mount of a size and shape corresponding to the size and shape of said opening and snugly received within the latter thereby defining edge means for preventing translational and rotational movement, said projection mount including a threaded bore formed therein, the other assembly including a threaded shank portion threadedly engaged in said bore and an oppositely projecting smooth shank selectively removably engagable in a selected aperture of said apertures, said adornment assembly including an adornment body supported therefrom facing outwardly from said belt.

2. The combination of claim 1 wherein said mount is carried by said adornment assembly and said threaded shank portion is carried by said belt length adjusting assembly.

3. The combination of claim 1 wherein said threaded bore is blind and said threaded shank portion is tightly bottomed therein to "jamb" the threads of said threaded shank portion in said threaded bore.

4. The combination of claim 1 wherein the effective length of said outwardly projecting mount is substantially equal to the thickness of said strap.

5. The combination of claim 1 wherein the outer end of said smooth shank includes a ball-like enlargement thereon.

6. The combination of claim 1 wherein said opening is generally square in cross sectional shape.

7. The combination of claim 1 wherein said threaded bore is blind and said threaded shank portion is tightly bottomed therein to "jamb" the threads of said threaded shank portion in said threaded bore, the effective length of said outwardly projecting mount being substantially equal to the thickness of said strap.

8. The combination of claim 7 wherein said mount is carried by said adornment assembly and said threaded shank portion is carried by said belt length adjusting assembly.

9. The combination of claim 8 wherein the outer end of said smooth shank includes a ball-like enlargement thereon.

* * * * *